US009468276B1

(12) United States Patent
Jorden et al.

(10) Patent No.: US 9,468,276 B1
(45) Date of Patent: Oct. 18, 2016

(54) LUGGAGE MOBILITY ASSEMBLY

(71) Applicants: James Jorden, Tomball, TX (US); Bonnie Jorden, Tomball, TX (US)

(72) Inventors: James Jorden, Tomball, TX (US); Bonnie Jorden, Tomball, TX (US)

( * ) Notice: Subject to any disclaimer, the term of this patent is extended or adjusted under 35 U.S.C. 154(b) by 0 days.

(21) Appl. No.: 14/686,379

(22) Filed: Apr. 14, 2015

(51) Int. Cl.
*A45C 13/38* (2006.01)
*A45C 5/00* (2006.01)

(52) U.S. Cl.
CPC ..... *A45C 5/00* (2013.01); *A45C 13/385* (2013.01)

(58) Field of Classification Search
CPC ..... A45F 5/021; A45C 13/001; A45C 13/38
USPC ..... 190/18 A, 102; 224/184; 280/1.5
See application file for complete search history.

(56) References Cited

U.S. PATENT DOCUMENTS 2,613,953 A * 10/1952 Giovannoni ..... B62B 5/068 182/16
3,328,043 A * 6/1967 Johnson ..... B62B 5/068 280/1.5
5,215,315 A * 6/1993 Belter ..... F02B 77/11 277/597
5,622,294 A * 4/1997 Evans ..... B62B 5/068 224/184
6,027,001 A * 2/2000 Levitan ..... A45F 3/14 224/184
6,098,993 A * 8/2000 Bellinson ..... B62B 9/20 280/1.5
6,978,485 B2 * 12/2005 Stude ..... B62B 5/068 2/312
7,246,802 B2 * 7/2007 Yeung ..... B62D 63/064 190/108
8,091,899 B2 * 1/2012 Mejia ..... B62B 5/068 224/184
8,307,966 B2 * 11/2012 Cummins ..... A45F 5/00 190/102
2004/0040350 A1 * 3/2004 Derman ..... E05B 73/0005 70/58
2004/0050636 A1 * 3/2004 Forbes ..... B62B 5/068 190/18 A
2005/0115998 A1 * 6/2005 Swenson ..... B62B 5/068 224/184
2006/0196901 A1 * 9/2006 Benk ..... A45C 13/30 224/184
2007/0164067 A1 * 7/2007 Wright ..... A45F 5/00 224/401
2011/0062196 A1 * 3/2011 Weiss ..... A45F 3/14 224/184
2011/0132952 A1 * 6/2011 Peterson-Malesci ..... A45F 5/02 224/660
2011/0240704 A1 * 10/2011 Smith ..... A45F 5/02 224/676
2012/0111908 A1 * 5/2012 Ellsworth ..... A61M 16/0672 224/254
2013/0048685 A1 * 2/2013 Durkos ..... A45F 3/14 224/184
2014/0008402 A1 * 1/2014 Dickson ..... A45F 5/021 224/184

* cited by examiner

*Primary Examiner* — Sue A Weaver
(74) *Attorney, Agent, or Firm* — Law Office of Jeff Williams; J. Oliver Williams

(57) ABSTRACT

The present application includes an assembly for transporting luggage including a carrying member configured to releasably couple the luggage to a traveler around the core portion of the body. The carrying member coupled to a portion of the apparel and to the luggage handle. Loads exerted by the weight of the luggage are placed over the lower body. The method includes the steps of obtaining a carrying member and attaching it to a traveler, followed by attaching the luggage to the carrying member. The traveler may remove or adjust as necessary.

2 Claims, 2 Drawing Sheets

LUGGAGE MOBILITY ASSEMBLY

BACKGROUND

1. Field of the Invention

The present application relates generally to luggage devices and, more particularly, to an assembly to ease the transportation of luggage.

2. Description of Related Art

Luggage comes in many forms. Historically luggage was often carried by an individual by using hand grips or straps over the shoulder. More recently luggage is also transported by an individual where the luggage includes wheels and requires the individual to drag the luggage behind them. Advancements in making luggage more simple to transport have been made, particularly, for the benefit of the frequent traveler. Frequent travelers, such as airline employees, can experience chronic pain in the shoulders, back, and neck from the need to carry luggage. The stresses placed upon the body from conventional luggage tends to unnaturally load the body. A new system or assembly is needed to allow travelers the ability to transport luggage without unnaturally loading the body and causing chronic pain.

It is desirable to provide a luggage mobility assembly for transporting luggage. Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
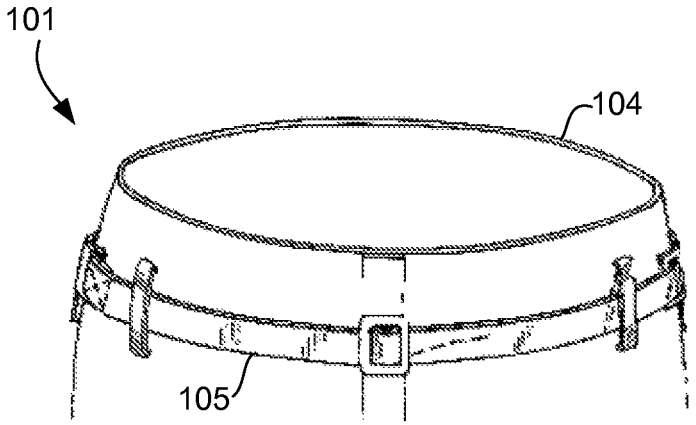
FIGS. 1 and 2 are perspective views of a luggage mobility assembly inserted through belt loops according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional methods of transporting luggage. Specifically, the assembly of the present application is configured to relieve the stress applied to the shoulders, neck, and back of the traveler during transportation by locating the weight of the luggage about the core of the traveler. It is also an advantage of the present application that the assembly also acts to free up the travelers hands and arms for other purposes at the same time of transporting luggage. A method of transporting luggage is herein described wherein the traveler couples the luggage to the core of the traveler via a carrying member. Such assembly and methods are designed to prevent and alleviate chronic pain issues that tend to develop from the frequent transportation of luggage. These and other unique features of the system are discussed below and illustrated in the accompanying drawings.

The mechanism will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The luggage mobility assembly of the present application is illustrated in the associated drawings. The assembly includes at its most basic structure a carrying member configured to couple to the core of an individual and a handle of the luggage so as to transfer the loads generated from pulling and holding the luggage to the legs of a traveler. The assembly may further include a body attachment member in situations where the individual is not already equipped with means for using the carrying member.

Figure 2:
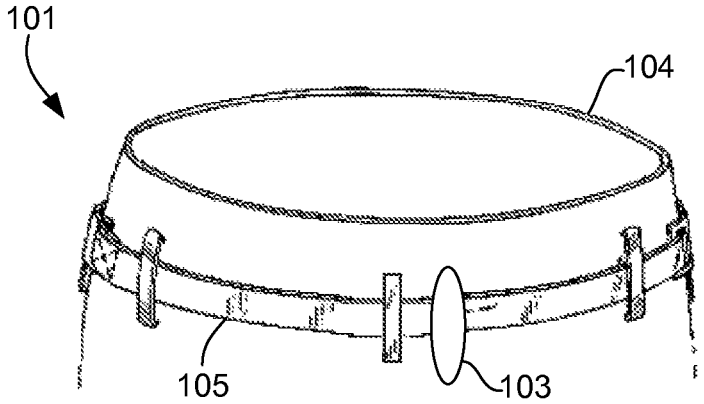

Referring now to the drawings wherein like reference characters identify corresponding or similar elements in form and function throughout the several views. FIGS. 1 and 2 in the drawings illustrate a perspective view of luggage mobility assembly 101. Assembly 101 includes a carrying member 103 configured to transfer the loads exerted by luggage to the core of a traveler, so as to free up the stresses exerted on the arms, shoulders, back, and neck of the traveler. Reference to the core of the traveler relates to the waist about the hips of the traveler. Loads carried here are handled by the legs and avoids stresses or loads being placed upon the neck, back, shoulders, and arms of the traveler. Carrying the loads about the core of the traveler reduces chances of chronic pain and injury due to frequent luggage transportation.

As seen in FIG. 2, carrying member 103 is coupled to the apparel of the traveler, about the traveler's belt 105. The belt passes through a series of belt loops and is used to hold up the pants 104. In situations where the traveler wears a belt, assembly 101 is configured to couple to any portion of belt 105. Additionally the traveler may selectively relocate carrying member 103 to any other location along belt 105 merely by translating member 103 about belt 105. It is ideal that carrying member 103 be located in the rear portion of the traveler as centered with the torso as possible, so as to avoid any torqueing effects on the back.

Figure 3:
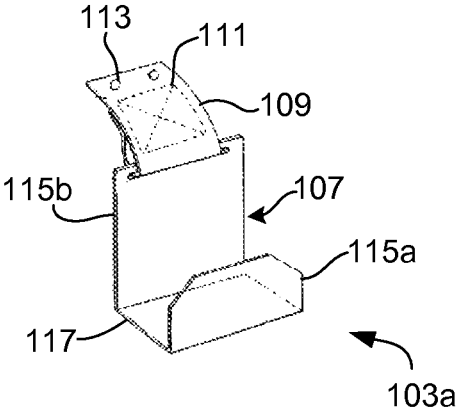
FIG. 3 is a perspective view of one embodiment of a carrying member of FIGS. 1 and 2.

Referring now also to FIG. 3 in the drawings, a perspective view of one embodiment of carrying member 103, shown as carrying member 103*a*, is illustrated. In this embodiment, carrying member 103*a* includes a slot 107 and a strap 109. Strap 109 is configured to releasably couple slot 107 to the traveler (i.e. to the apparel such as belt 105). Strap 109 may include a fastener to permit the releasable coupling as described. An example of a releasable fastener is a hook and loop fastener 111 or a snap/button fastener 113. To attach, the traveler merely passes strap 109 around belt 105 and engages the fasteners 111 and/or 113. When transportation is complete, the traveler reaches back and unfastens carrying member 103 from belt 105.

Slot 107 includes an aperture for the passage of strap 109. Slot 107 is configured to hang down from strap 109 and includes rigidly formed shape having two parallel sections 115*a*, 115*b* connected via a single cross section 117. Cross section 117 extents between sections 115*a*, 115*b* at neighboring ends so as to form a slot between sections 115*a*, 115*b* to accept the luggage. Carrying member 103*a* is configured to permit the unrestricted insertion and removal of the luggage handle from slot 107.

Figure 6:
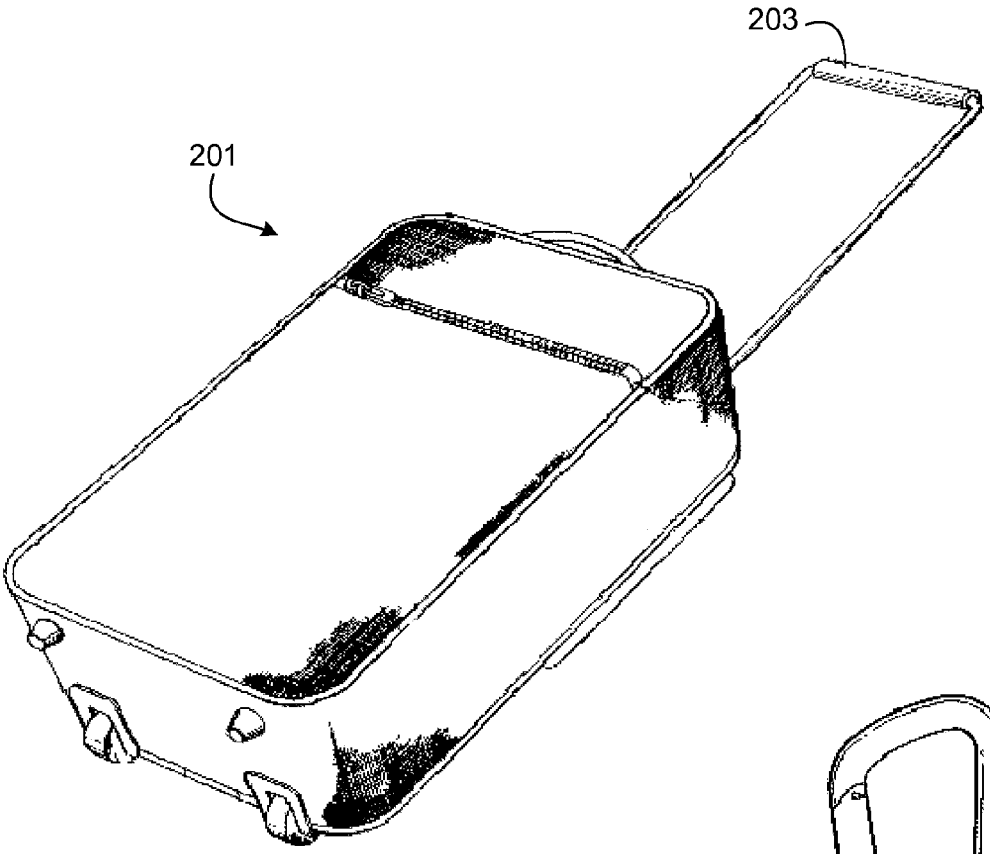
FIG. 6 is a perspective view of a wheeled piece of luggage for use with the luggage mobility assembly of FIGS. 1 and 2.

Referring now also to FIG. 6 in the drawings, a perspective view of a wheeled piece of luggage 201 for use with the luggage mobility assembly 101 is illustrated. Wheeled luggage 201 includes a handle 203 for directing and supporting the luggage 201 during transportation. Carrying member 103 is configured to couple to handle 203. It is understood that carrying member 103 engages handle 203 directly, however, other straps and connections may be used between carrying member 103 and handle 203. Therefore carrying member 103 needs to only be in communication with handle 203, such that carrying member 103 transfers a portion of the loads of luggage 201 to the traveler.

Figure 4:
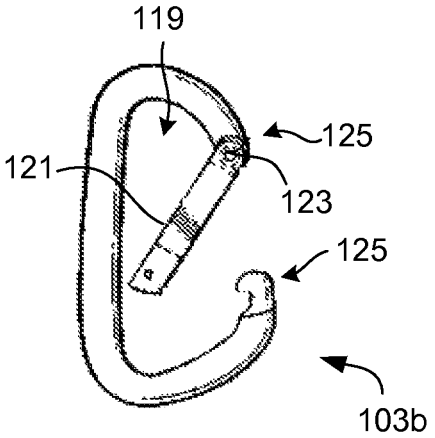
FIG. 4 is a perspective view of a second embodiment of a carrying member of FIGS. 1 and 2.

Referring now also to FIG. 4 in the drawings, a perspective view of a second embodiment of carrying member 103, shown as carrying member 103*b*, is illustrated. Carrying member 103*b* is configured to releasable couple to the apparel of the traveler (i.e. belt 105). Carrying member 103*b* is similar in form and function to that to carrying member 103*a*. One particular difference between carrying member 103*a* and 103*b* is that carrying member 103*b* is configured to form an enclosed area 119 so as to prevent the unauthorized and accidental separation of luggage 201 from the traveler. Carrying member 103*b* includes a closing member 121 configured to selectively alternate between a closed and open orientation. Handle 203 is configured to pass through closing member when in an open orientation. Handle 203 is restricted from removal from carrying member 103*b* when closing member 121 is in a closed orientation. Another distinction between closing member 103*a* and 103*b* is that the apparel of traveler and handle 203 are configured to both pass through closing member 121 and reside in the same enclosed area 119. In carrying member 103*a*, the apparel of the traveler and handle 203 reside in separate designated areas.

FIG. 4 illustrates closing member 121 as being a latch that pivots about an axis 123. The latch extends between two opposing ends 125 of carrying member 103*b*. Some embodiments of closing member 121 include a biasing member to automatically close closing member, contacting both opposing ends 125. It is understood that other embodiments of closing member 121 are possible and may function within the present scope of the description. For example, closing member 121 may include threaded fastening connections and a corresponding nut.

Figure 5:
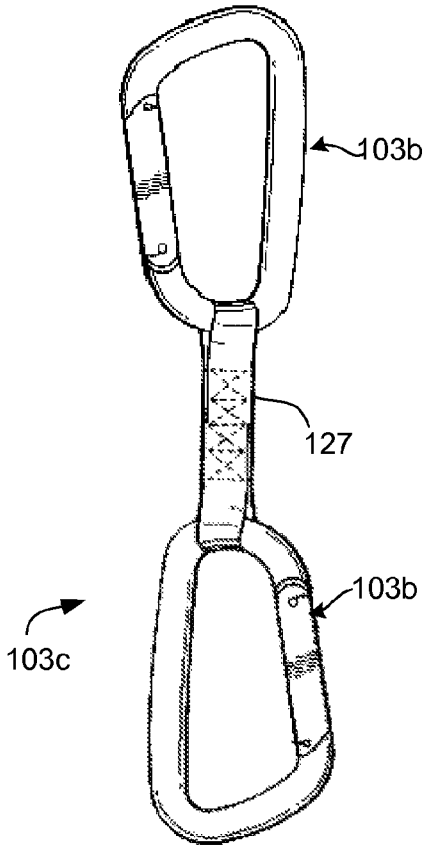
FIG. 5 is a perspective view of a third embodiment of a carrying member of FIGS. 1 and 2.

Referring now also to FIG. 5 in the drawings, a perspective view of a third embodiment of a carrying member 103, shown as carrying member 103*c*, is illustrated. Carrying member 103*c* is similar in form and function to that of carrying member 103*b* except as noted herein. Carrying member 103*c* includes two distinct carrying members 103*b* and an attachment member 127. Attachment member 127 couples both carrying members 103*b* to one another and is configured to permit for the rotation and relative movement between luggage 201 and the traveler. Attachment member 127 is configured to be removable from each carrying member 103*b* by activation of closing member 121. Use of carrying member 103*c* can help avoid the effects of twisting on belt 105 by absorbing the twisting within attachment member 127. In use, the enclosed area of one carrying member 103*b* is used to encapsulate the apparel of the traveler (i.e. belt 105) and the other is used to encapsulate handle 203.

Figure 7:
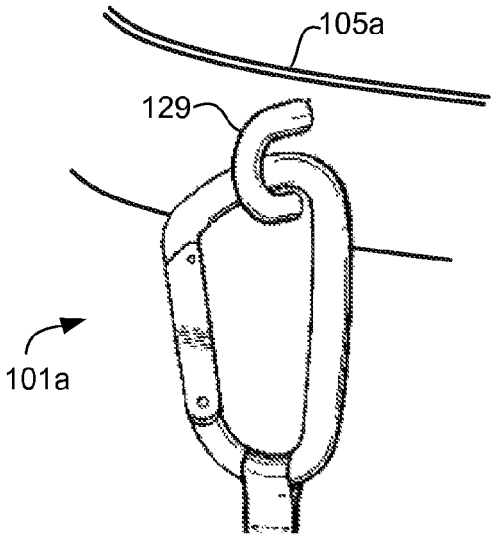
FIG. 7 is a perspective view of an alternative embodiment of the luggage mobility assembly of FIGS. 1 and 2.

Referring now also to FIG. 7 in the drawings, a perspective view of an alternative embodiment of luggage mobility assembly 101 is illustrated. In embodiments where assembly 101*a* includes both carrying member 103 and belt 105, belt 105 and carrying member 103 may be secured together as a single assembly. FIG. 7 illustrates carrying member 103*b* and belt 105*a*. Carrying member 103*b* is not removable from belt 105*a* in this embodiment. Belt 105*a* includes a retaining member 129 integrally formed within itself. As seen in the figure, carrying member 103*c* is actually depicted, however, carrying member 103*c* includes member 103*b*. It is understood that assembly 101*a* may alternatively include member 103*a* wherein member 103*a* is stitched and wrapped through retaining member 129. Such an embodiment is particularly useful when the apparel of the traveler does not lend itself to a loop or belt sufficient to attach carrying member 103. For example, stewardesses often wear dresses that do not have a belt. In such an instance, assembly 101 or 101*a* may be useful.

In use, a traveler obtains a carrying member and releasably attaches the carrying member to a portion of their apparel. Usually this is a belt as shown and described. By using the belt, the weight of the luggage is placed over the hips and carried primarily by the lower portion of the body and not any portion of the upper body, thereby alleviating fears of chronic pains in the upper body. Once located, the traveler attaches the handle of the luggage to the carrying member and may then begin moving (i.e. walking, running, standing). The luggage handle may rest in slot 109 or within enclosed area 119.

At any point, the traveler is able to reach behind and disconnect or remove the luggage from the carrying member. In instances where the travel is using an assembly with the belt, the travel attaches the belt first and then attaches the carrying member. Some embodiments may include an integrally attached carrying member in which case the added step of attaching the carrying member may be removed. The traveler may adjust the location of the carrying member relative to the apparel and along the belt (if used) as necessary. The carrying member may be translated around the traveler.

The current application has many advantages over the prior art including at least the following: (1) application of current to brake the motor; (2) time delayed response to cutting power to the motor to allow for the motor brake to be applied; (3) unnecessary to use processors; (4) mechanical mechanism applied automatically; and (5) operable with both AC and DC power supplied rotary tools.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A luggage mobility assembly for transporting luggage, comprising:

a carrying member configured to releasably couple the luggage around a portion of a body of a traveler, the carrying member configured to selectively engage a handle of the luggage, the carrying member selectively closing around the handle of the luggage to prevent unauthorized and accidental separation of the luggage from the traveler, the carrying member forming an enclosed area;

a belt member configured to wrap around a waist of the traveler, the belt member configured to pass through a portion of the carrying member;

wherein loads exerted by the luggage are passed through the carrying member and to the traveler;

wherein the carrying member includes a closing member configured to selectively open or close, the handle being permitted to pass through and into the carrying member when the closing member is in an open position.

2. The assembly of claim 1, further comprising:

a second carrying member coupled to the first carrying member via an attachment member, the attachment member configured to permit relative movement between the carrying member and the second carrying member, the second carrying member having an enclosed area;

wherein the enclosed area of the carrying member is configured to accept the belt member and the enclosed area of the second carrying member is configured to accept the handle of the luggage.

* * * * *